US007690072B2

(12) United States Patent
Ozdogan

(10) Patent No.: US 7,690,072 B2
(45) Date of Patent: Apr. 6, 2010

(54) SIDE CUTTING TOOL

(76) Inventor: Ercan Ozdogan, 1 Aberdeen Road, St Andrews, NSW, 2566 (AU)

( * ) Notice: Subject to any disclaimer, the term of this patent is extended or adjusted under 35 U.S.C. 154(b) by 1043 days.

(21) Appl. No.: 11/391,424

(22) Filed: Mar. 29, 2006

(65) Prior Publication Data

US 2006/0225238 A1 Oct. 12, 2006

(51) Int. Cl.
*A47L 13/10* (2006.01)

(52) U.S. Cl. ..... 15/210.1; 15/244.1; 15/248.1

(58) Field of Classification Search ..... 15/210.1, 15/209.1, 50.1–52, 244.1–244.4, 246, 248.1, 15/248.2, 166, 230.11; 118/256, 264, 504
See application file for complete search history.

(56) References Cited

U.S. PATENT DOCUMENTS 3,930,278 A * 1/1976 Nasca ..... 15/166
4,564,970 A * 1/1986 Latraverse ..... 15/230.11
5,623,740 A * 4/1997 Burns et al. ..... 15/230.11
6,574,824 B2 * 6/2003 Burns et al. ..... 15/230.11

* cited by examiner

*Primary Examiner*—Dung Van Nguyen
(74) *Attorney, Agent, or Firm*—Molins & Co.

(57) ABSTRACT

A side cutting tool has a sponge 1 inserted within a hand piece 2. The sponge 1 is fixed within the hand piece 2 by a pin 3 inserted through adjustment holes 4 in a handle 5. A suspended plate 8 is inserted adjacent to the curved face 9 of the hand piece 2. The suspended plate 8 is fixed within the hand piece 2 by a pin 10 inserted through holes 11 and 12 in the suspended plate 8 and holes 13 and 14 in the hand piece. An adjustment plate 15 is inserted between the suspended plate 8 and the curved face 9 of the hand piece 2.

10 Claims, 6 Drawing Sheets

5
4
203
15
1
303
11
12
301
8
302
14
17
205
3
13
7
16
9
102
10
2
6

SIDE CUTTING TOOL

FIELD OF THE INVENTION

This invention relates to devices for painting, and more particularly to a side cutting tool.

BACKGROUND OF THE INVENTION

Due to the fact that cornices, skirting boards and doorframes are painted with differing types of paint and/or differing colours to their adjoining walls, many painters, professional or hobbyist, find painting these areas a tedious, time consuming exercise. Also the location of cornices and skirting boards require the painter to spend long periods of time on a ladder, or crouched low. This awkwardness may affect the painter's work and contribute to unnecessary discomfort.

Previous methods such as protecting the surface with masking tape while the adjoining surface is painted provide not only additional costs but prove to be time consuming.

Painting these detail areas (as described in the first paragraph) is referred to as "cutting the side". Hence, the invention is referred to as "side cutting tool".

The side cutting tool overcomes the need to protect surfaces adjoining the one being painted on from un intended brush strokes and allows for faster and more effective painting. The invention is also suitable for working in other detail areas such as around light switches.

SUMMARY OF THE INVENTION

In one form of the invention the handle unit comprises a robust metal hand piece in the form of hollow prism in which a painting element is inserted. The painting element protrudes through the bottom of the main body of the hand piece, allowing paint to be applied to surfaces. The hand piece has one preferably curved front surface that allows the device to be smoothly run along cornices, skirting boards and doorframes. The invention uses a suspended plate inserted into the hand piece near the curved front side of the hand piece. The painting element is fixed within the hand piece by a pin. During the painting process the suspended plate cooperates with the adjustment plate that lies adjacent to or against the surface which is to be kept clear from paint. The adjustment plate acts as a barrier between the two perpendicular surfaces, which eliminates the need to protect one surface with masking tape. In preferred embodiments, the adjustment plate is inserted between the shielding plate and the curved from surface of the hand piece. The adjustment plate may be adjusted vertically so as to adjust the level of protection the surface perpendicular to the one being painted received. The hand piece is considered a useful invention, with or without the presence of the replaceable painting element.

The hand piece may be made of any suitable material, such as timber, metal, plastic or any combination thereof.

A painting element such as a sponge is inserted into the hand piece and fixed in place by a pin through the sponge handle and the sides of the hand piece. The painting element could be any suitable material, natural or synthetic.

The painting element is an accessory fixed to the hand piece by a pin which is inserted through the sides of the hand piece and the sponge handle.

The sponge handle contains numerous adjustment holes so as to allow for adjustment of the amount of sponge which protrudes from the hand piece. The fine-tuning allowed by the adjustment holes will be particularly useful as the sponge ages.

BRIEF DESCRIPTION OF THE DRAWING FIGURES

To assist with understanding the invention, reference will now be made to the accompanying drawings which show one example of the invention.

BEST MODE AND OTHER OBJECTS OF THE INVENTION

Figure 1:
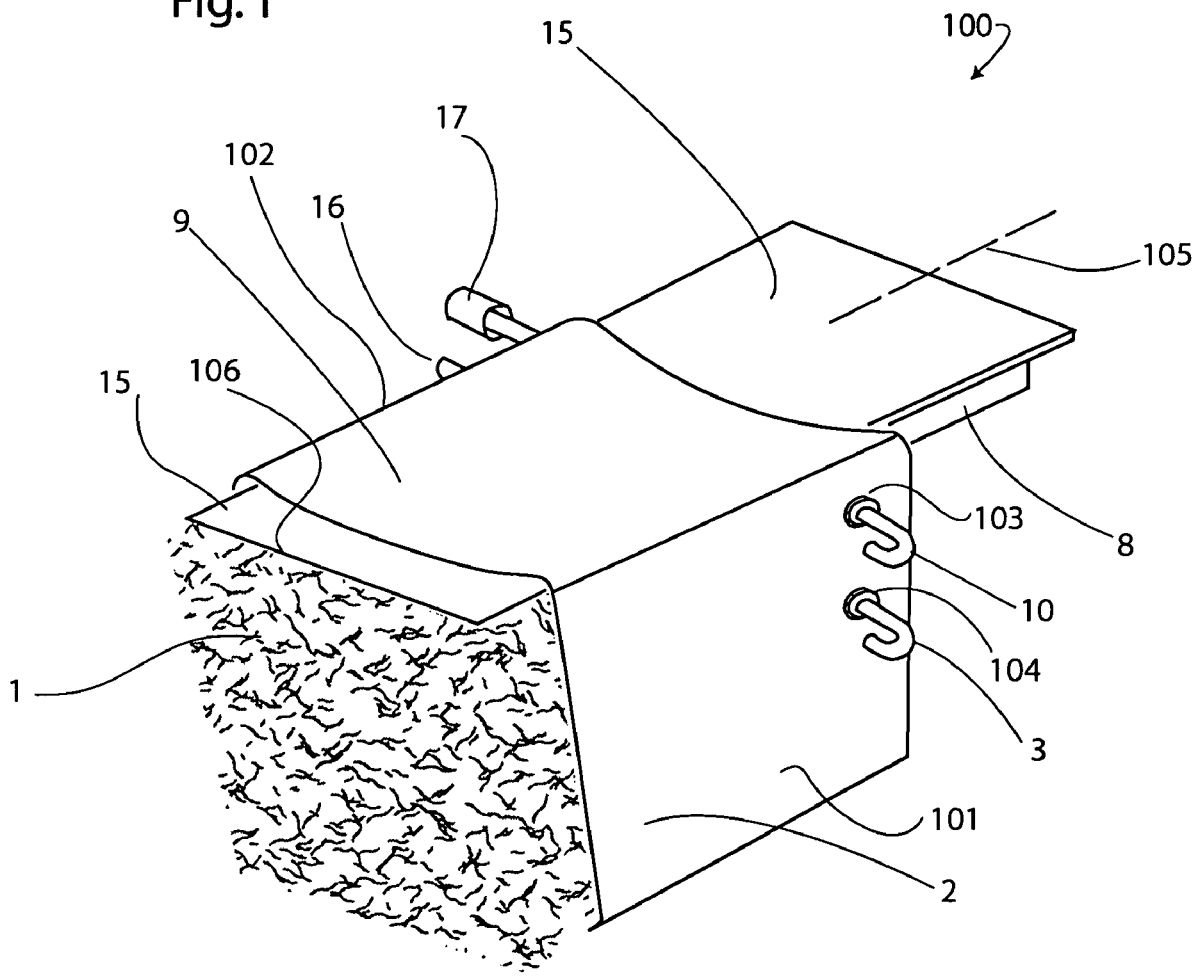
FIG. 1 is a perspective view showing one example of a side cutting tool according to the invention.

As shown in FIG. 1, an all metal side cutting tool 100 comprises a hollow generally prismatic (in cross-section) hand piece 2 that receives a cooperating painting element, e.g. sponge 1. In this example, the hand piece 2 has generally parallel sides 101 and a rear face 205. The front face 9 in this example is uniformly concave, joining the sides 101 at slightly rounded corners 102. The upper extent of each of the sides 101 has a pair of holes 103, 104 formed in it. The forward (or lower) pair of holes 103 receives a transverse first pin 10. The pin 10 is intended to penetrate the sponge 1 and exit the opposite side of the hand piece 2. That portion of the first pin 10 that protrudes beyond the side of the hand piece is coverable with a protective cap 17. The second opening 104 receives a second pin 3 that may be similarly capped 16. As better shown in FIG. 2, the second pin 3 passes through an opening in a sponge handle 5 as will be explained. The pins may have hooked ends for ease of withdrawal.

The side cutting tool also features a suspended plate 8 that acts as a barrier between the sponge 1 and any surface forward of it such as an adjustment plate. An adjustment plate 15 is optionally insertable between the suspended plate 8 and the front face 9. The suspended plate 8 preferably pivots about and is suspended from the first pin 10. The adjustment plate 15 can reciprocate along the longitudinal axis 105 of the side cutting 100. This provides a considerable degree of adjustment capability with respect to the amount of wet sponge surface that protrudes from the lower edge 106 of the adjustment plate 15.

Figure 2:
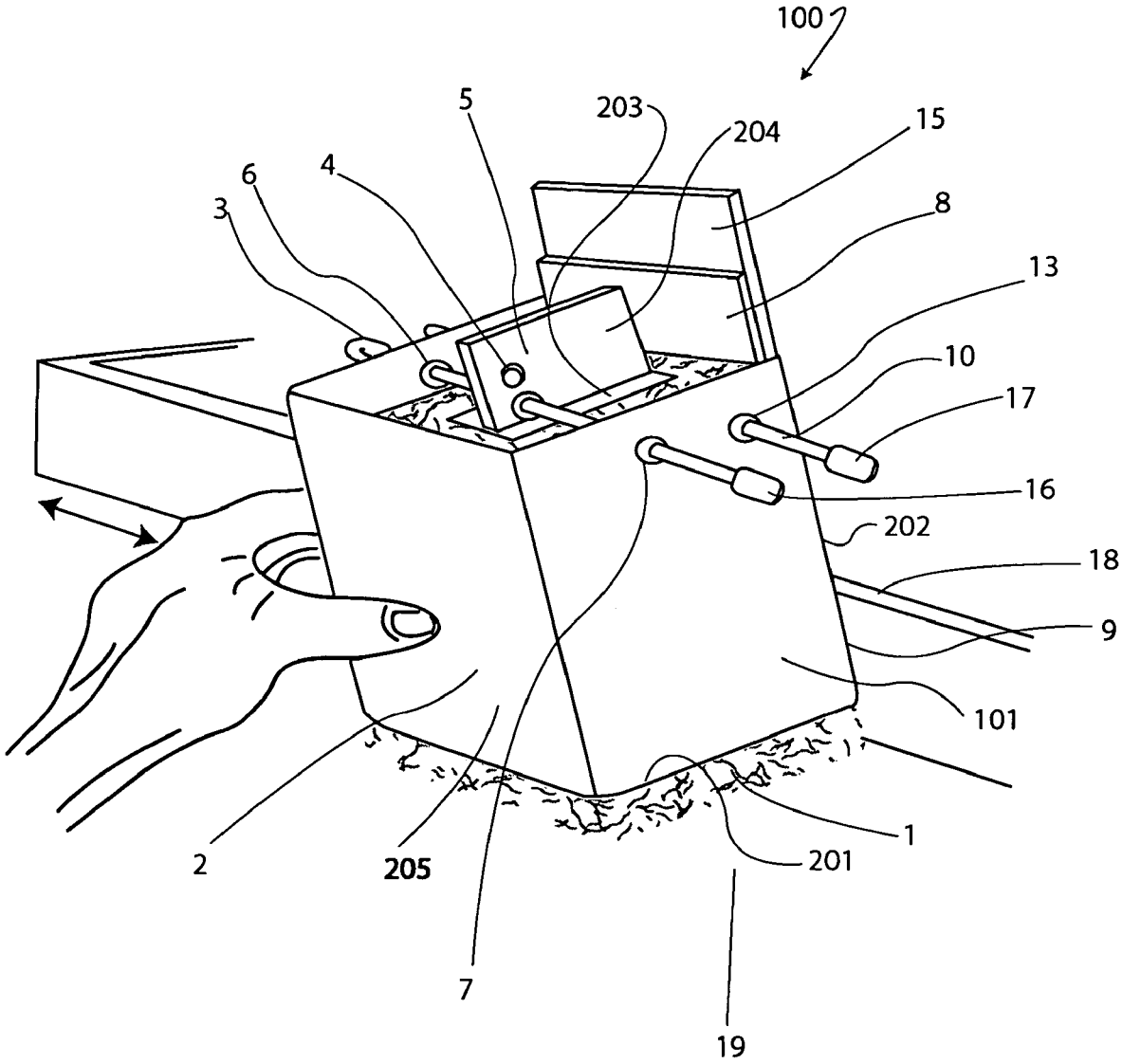
FIG. 2 shows a side cutting tool in use along a doorframe.

As shown in FIG. 2, in preferred embodiments, the lower edges 201 of the sides 101 are slightly acute and not precisely perpendicular with the front edges 202 of the sides 101. This allows the front edges 202 to be inclined away from the surface to be protected, in this example, a door frame 18.

FIG. 2 also illustrates the deployment of the sponge handle 5. In this example, the sponge handle 5 is generally "T" shaped having a flat base portion 203 and a centrally located upright rib portion 204. The upright rib portion 204 has one or more openings 4 formed in it. When there are two or more openings 4, selection between them allows the degree of compression on a sponge or the location of the sponge to be adjusted. Notice that the second pin 3 can be located in any one of the vertically aligned adjustment openings 4.

Figure 3:
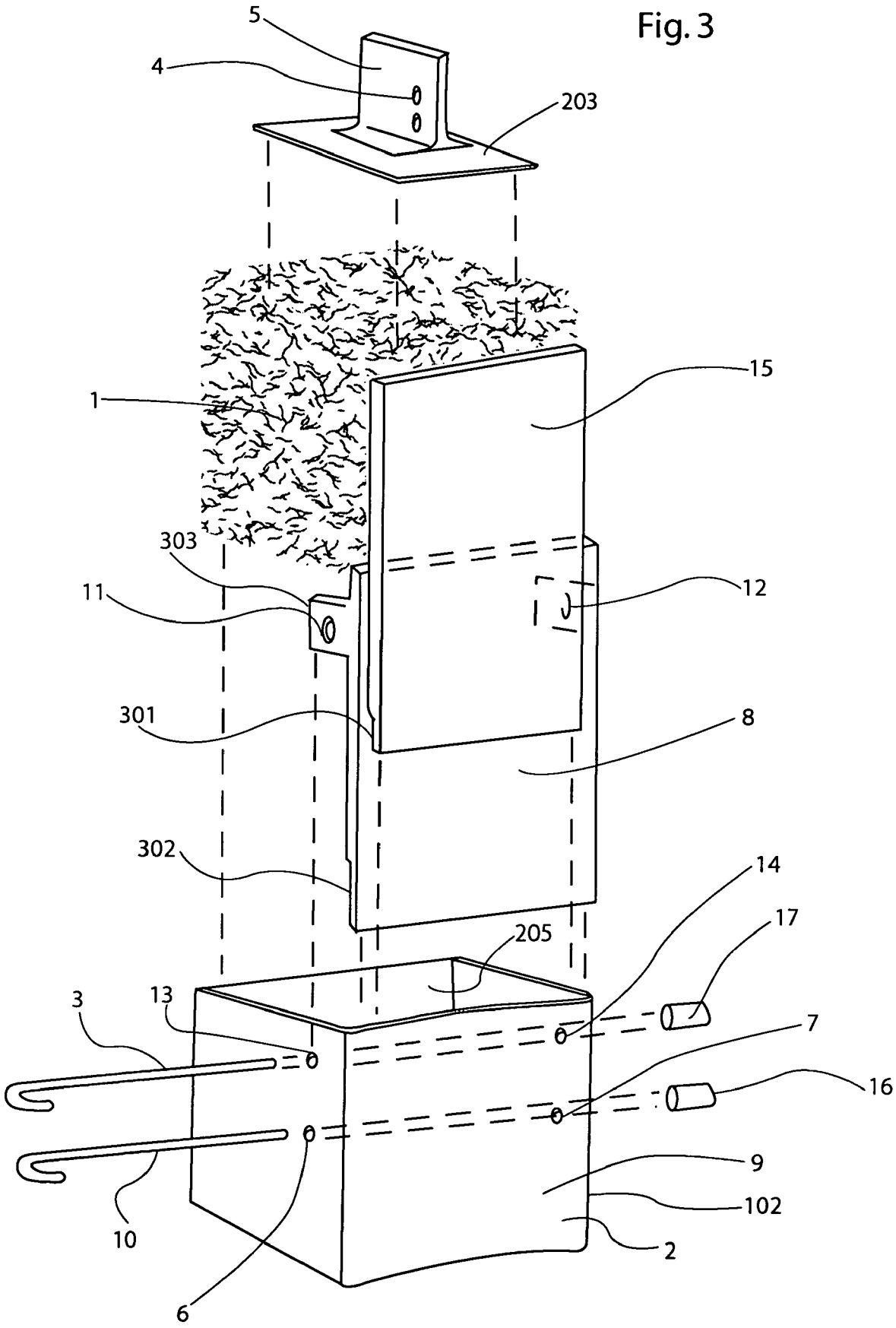
FIG. 3 is an exploded perspective assembly drawing of a side cutting tool.

As shown in FIG. 3, both the suspended plate 8 and the adjustment plate 15 may be provided with stepped lower edges 301, 302. Further, the suspended plate 8 may be provided with side tabs 303 that extend toward the rear of the device. Each tab is provided with a hole 11, 12. The first pin 3 can optionally pass through the holes 11, 12 thus fixing the suspended plate 8 in position relative to the hand piece 2 other means of pivoting the suspended plate 8 may be used.

Figure 4:
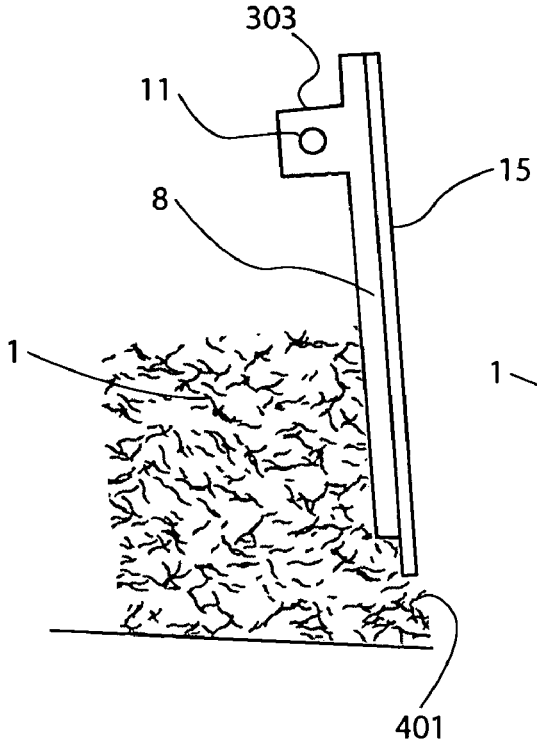
FIG. 4 is a side view of a sponge, and suspended plate and adjustment plate.
Figure 5:
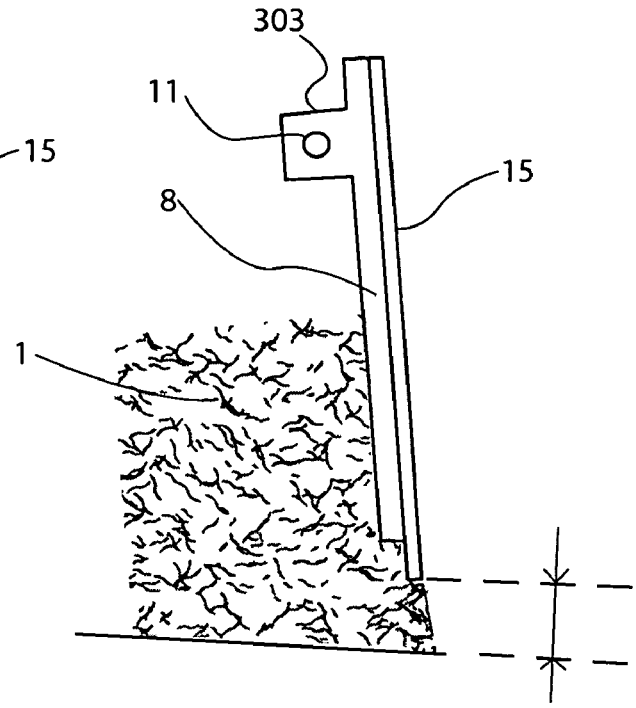
FIG. 5 is a side view of the sponge and adjustment plate set to allow paint to the front of the sponge.
Figure 6:
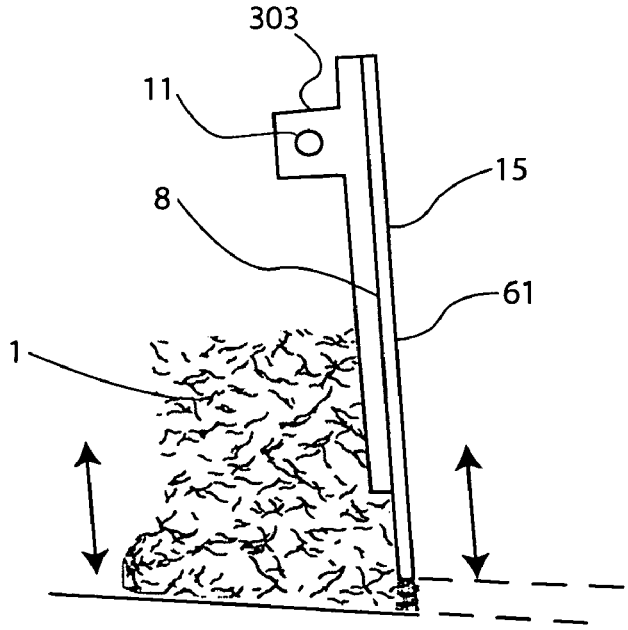
FIG. 6 is a side view suggesting that the adjustment plate can be moved downwards along the sponge thereby urging excess paint away from the front of the sponge.

As shown in FIG. 4, the suspended plate 8 is held in place because the first pin passes through the openings 11 and 12 formed in the tabs 303. Vertical movement of the adjustment plate 15 thereby increases or decreases the amount of wet sponge 401 protruding beneath both the suspended plate 8 and the adjustment plate 15. As suggested by FIG. 5, the vertical adjustment plate 15 can be raised or lowered to allow differing amounts of sponge to protrude. As suggested by FIG. 6, the adjustment plate 15 can be lowered so that only a very small amount of sponge protrudes below the adjustment plate 15. The adjustment plate 15 can be lowered fully so that the front surface 61 of the adjustment plate 15 completely protects the surface adjacent to the painted one.

Figure 7:
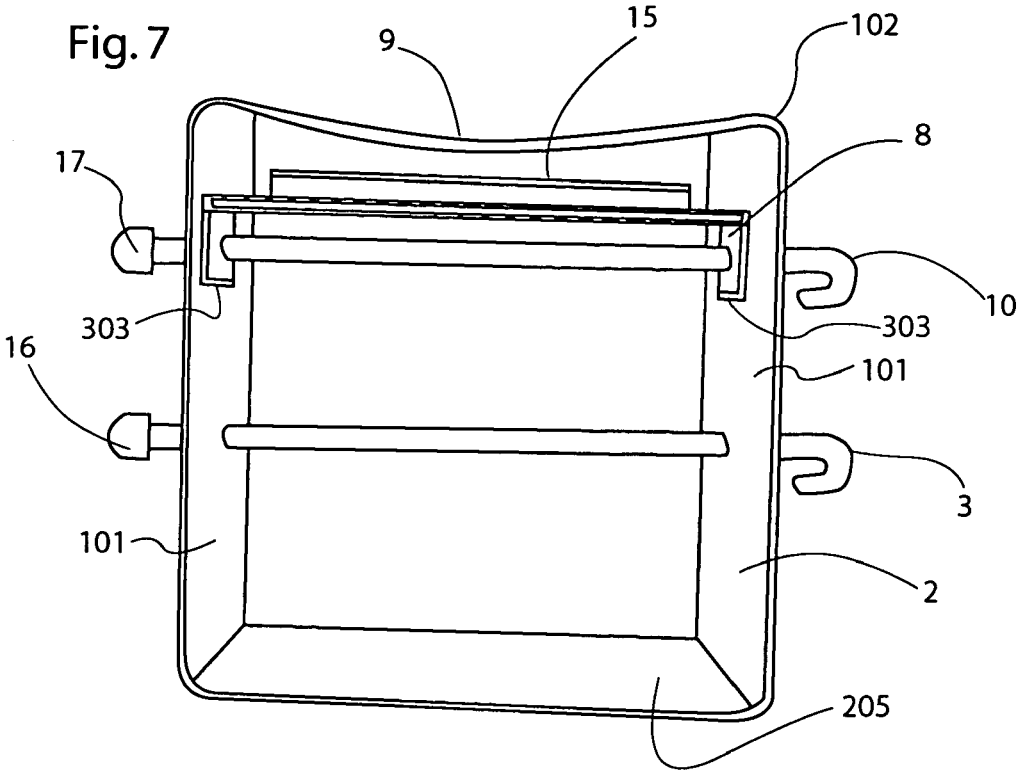
FIG. 7 is a top view of the hand piece.

FIG. 7 is a top plan view of the device with the painting element or sponge removed. In this view the rounded corners 102 between the sides 101 and the concave front surface 9 are clearly visible. The adjustment plate 15 is shown as located between the suspended plate 8 and the concave front surface 9. The first pin 10 is shown as passing through both side tabs 303 of the suspended plate 8.

Figure 8:
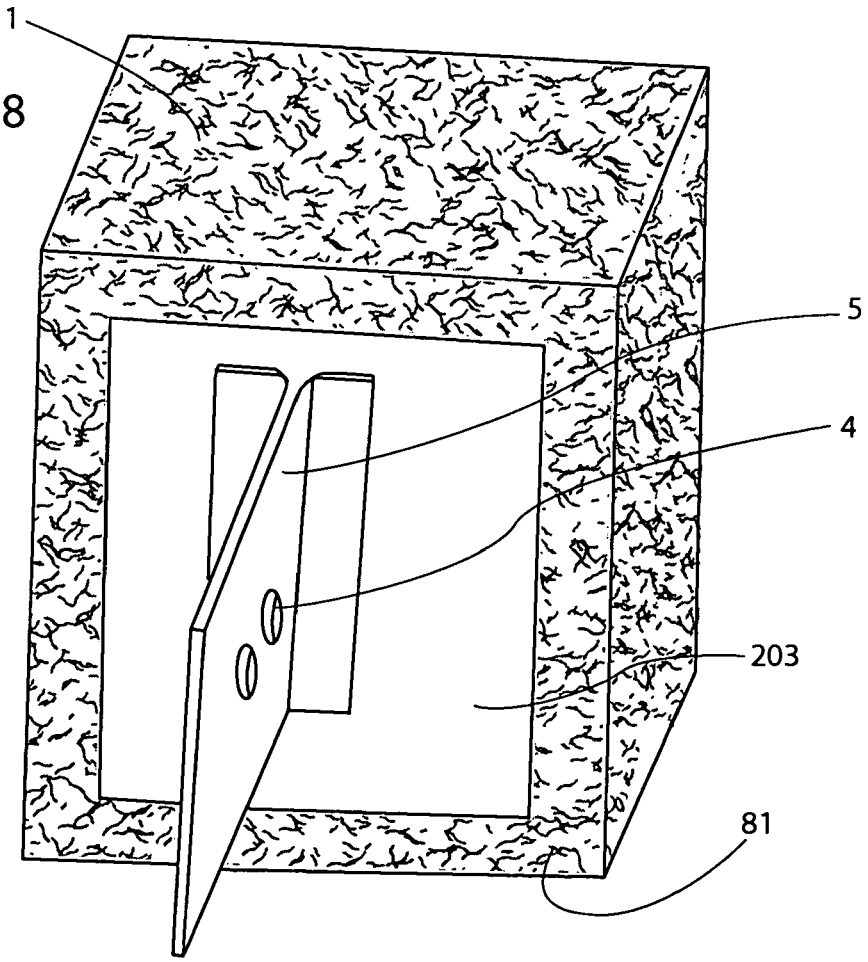
FIG. 8 is a perspective view of the sponge and the sponge handle with adjustment holes.

The sponge 1 and sponge handle 5 are shown clearly in FIG. 8. In this example, the base 203 of the sponge handle 5 is nearly as large as the cross sectional area of the top 81 of the sponge 1. Two vertically lined adjustment holes 4 are illustrated although it will be understood that more than two holes may also be provided.

Figure 9:
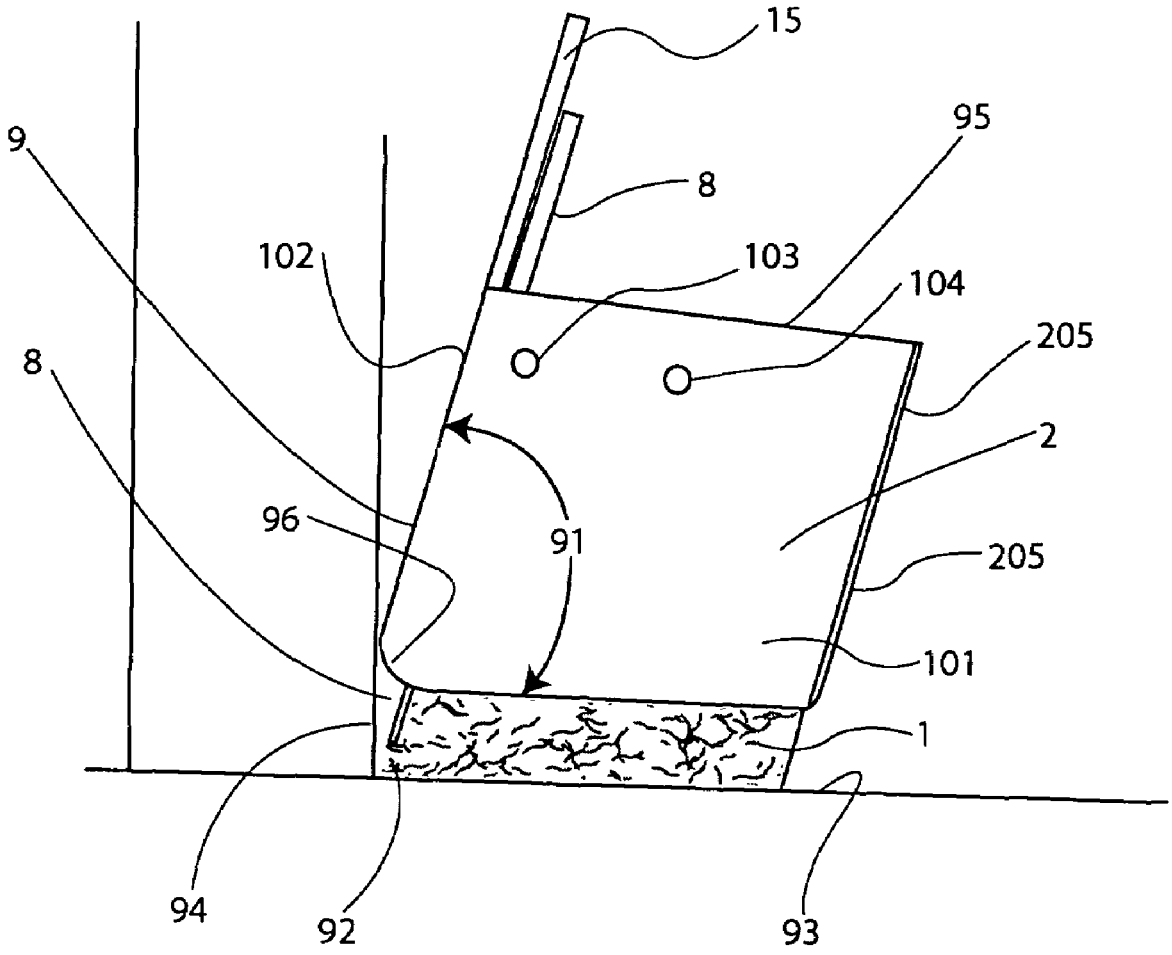
FIG. 9 shows a side view of the side cutting tool with the adjustment plate, suspended plate and sponge adjusted for use along adjoining surfaces.

As shown in FIG. 9, the acute angle 91 between the front edges 102 and the bottom edges of both the sides 101 (and the bottom surface of the sponge 1) allows the lower front edge 92 of the sponge 1 to make excellent contact in the area of the painted surface 93 closest to the protected surface 94. Note that in this example both the upper edges of the suspended plate 8 and of the adjustment plate 15 protrude above the top edge 95 of the hand piece 2. Note that the lower forward corner 96 is rounded to minimise the contact pressure between the hand piece and the protected surface 94. It can also be seen in this embodiment that the front edges 102 and the back surface 205 of the hand piece may be generally parallel.

It will be appreciated that as the sponge 1 wears down, the sponge handle may be lowered into the hand piece and reattached by inserting the second pin 3 into an adjustment hole 4 that is closer to the top of the sponge handle 5. Further, the painting characteristics of the front edge 92 of the sponge can be controlled by vertical adjustment of the adjustment plate 15 which can, in fact, be provided in varying thicknesses and edge configurations.

While the present invention has been described with reference to particular details of construction, these should be understood as having been provided by way of example and not as limitations to the scope or spirit of the invention.

What is claimed is:

1. A side cutting tool device, comprising:

a hollow body that supports a suspended plate that extends within the hollow body adjacent to and facing a front face of the body;

an adjustment plate extending between the suspended plate and the front face, within the body;

the body having a pair of aligned through openings that receive a pin, there being provided a painting element handle having an upright portion in which is formed one or more holes that can receive the pin.

2. The side cutting tool device of claim 1, wherein:

the suspended plate carries a pair of tabs into each of which are formed openings for receiving another pin, this other pin passing through another pair of aligned openings formed into sides of the body, the suspended plate pivoting about the other pin.

3. The side cutting tool device of claim 1, wherein:

the lower edge of the adjustment plate is stepped.

4. The side cutting tool device of claim 1, wherein:

the lower edge of the suspended plate is stepped.

5. The side cutting tool device of claim 1, wherein:

the lower edge of both the adjustment plate and suspended plate are stepped.

6. The side cutting tool device of claim 1, wherein:

the front face is concave.

7. The side cutting tool device of claim 6, wherein:

the body has sides and the front face is joined to the sides by rounded edges.

8. The side cutting tool device of claim 1, further comprising:

a painting element that fits into the body and protrudes from it.

9. The side cutting tool device of claim 1, wherein:

the body has two sides each having a bottom edge and the angle formed between the bottom edges and the front face, is acute.

10. The side cutting tool device of claim 1, wherein:

the body has two sides and the front face joins each of the sides along a rounded edge.

* * * * *